United States Patent [19]

Bugler, III et al.

[11] 4,208,359

[45] Jun. 17, 1980

[54] LOW HEAD NON-CLOGGING WATER DISTRIBUTION NOZZLE FOR COOLING TOWERS

[75] Inventors: Thomas W. Bugler, III, Prairie Village, Kans.; Gerald D. Fritz, Raytown, Mo.

[73] Assignee: The Marley Company, Mission, Kans.

[21] Appl. No.: 7,381

[22] Filed: Jan. 29, 1979

[51] Int. Cl.[2] ..... B01F 3/04

[52] U.S. Cl. ..... 261/111; 239/222.11; 239/500; 261/DIG. 11

[58] Field of Search ..... 261/97, 98, 110, 111, 261/DIG. 11, DIG. 72; 239/222.11, 498, 500

[56] References Cited

U.S. PATENT DOCUMENTS

| | | | |
|---|---|---|---|
| 453,055 | 5/1891 | Ware | 239/498 X |
| 458,607 | 9/1891 | Weiss | 239/498 X |
| 540,864 | 6/1895 | Lewis | 239/498 X |
| 1,597,715 | 8/1926 | Blackburn | 261/111 |
| 1,710,832 | 4/1929 | Mart | 261/111 X |
| 2,375,528 | 5/1945 | De Flon | 239/500 |
| 2,550,456 | 4/1951 | De Flon | 239/498 |
| 2,697,008 | 12/1954 | Rowley | 239/498 |
| 2,877,778 | 3/1959 | Kirby | 239/498 X |
| 3,617,036 | 11/1971 | Brown | 261/111 |
| 4,111,366 | 9/1978 | De Witte | 261/DIG. 11 |

FOREIGN PATENT DOCUMENTS

| | | | |
|---|---|---|---|
| 499855 | 6/1930 | Fed. Rep. of Germany | 261/111 |

*Primary Examiner*—Richard L. Chiesa

*Attorney, Agent, or Firm*—Schmidt, Johnson, Hovey & Williams

[57] ABSTRACT

A non-clogging liquid distribution assembly especially adapted for use in counterflow water cooling towers is provided which includes a hollow-cone, swirl-type nozzle and a series of circularly arranged, arcuate water-dispersing buttons disposed below the nozzle for breaking up water sprayed from the latter and uniformly dispersing the same over a relatively wide planar area in order to ensure adequate water cooling. The configuration and orientation of the buttons is carefully chosen so as to ensure that individual water particles from the nozzle angularly impinge against the dispersing buttons for maximum water breakup. The assembly is constructed for safely clearing foamed plastic or cellular synthetic rubber balls conventionally placed in cooling water systems to clear condenser tubes or the like. These balls are sized for a particular condenser tube system and vary from ½ in. to 1½ in.

13 Claims, 8 Drawing Figures

LOW HEAD NON-CLOGGING WATER DISTRIBUTION NOZZLE FOR COOLING TOWERS

BACKGROUND OF THE INVENTION

1. Field of the Invention

The present invention is broadly concerned with a low head pressure, non-clogging water distribution nozzle assembly especially designed for use in counterflow water cooling towers, including those of the mechanical draft as well as so-called natural draft towers. More particularly, it is concerned with such an assembly having, in preferred forms, a hollow-cone, swirl-type nozzle, along with a series of circularly arranged water-dispersing buttons disposed below the nozzle outlet and in circumferentially spaced relationship to one another for deflecting and dispersing water from the nozzle and in effect converting the hollow cone nozzle into a full cone spray nozzle.

2. Description of the Prior Art

Electrical utilities and other types of large scale industrial plants generally employ water cooling towers of one type or another for handling the large quantities of hot water produced during plant operations. In the case of utilities, very large towers of the natural draft counterflow variety are often employed. In such towers quantities of initially hot water are sprayed downwardly through the use of nozzles or the like over fill structure, while air currents are drawn upwardly in direct opposition to the descending water for cooling purposes. As can be readily appreciated, in order to be most efficient, such a counterflow tower must be equipped with nozzles or like mechanisms which effectively disperse the water to facilitate cooling thereof. At the same time, resistance to airflow on the part of the water-dispersing equipment must be minimized, in order to permit adequate quantities of air to be drawn in opposition to the descending hot water.

In the operation of a plant water cooling system, it is a common practice to periodically place a number of foamed plastic or cellular synthetic rubber-like balls into the cooling water in order to clean and clear out plant heat exchange tubes forming a part of the overall water cooling system. The balls are sized to be slightly larger in diameter than the pipes through which they are passed for cleaning purposes and therefore are generally available in diameters ranging from about ½ in. up to about 1½ in. Exemplary cleaning balls are sold under the trademark Amertap by Amertap Corporation. Given this practice, it will be seen that the associated cooling tower, and particularly the water-dispersing nozzles thereof, must be so constructed as to accommodate flow of such balls therethrough. Furthermore, even though such cleaning balls are normally removed after each use thereof, it inevitably follows that a number of the balls escape from the collection device and remain in the system to be continuously circulated through the tubes, cooling tower, and other portions of the overall cooling system; thus, the nozzles of the cooling tower must be capable of safely clearing such balls at all times.

Since water cooling systems are open to the atmosphere, it necessarily follows that the cooling water becomes contaminated to a certain extent with extraneous foreign objects such as fibers, twigs, scale and other particulate materials. The water dispersion and distribution systems must also clear these materials.

U.S. Pat. No. 3,617,036 describes a cooling tower nozzle particularly adapted for use in crossflowtype towers, but this nozzle is substantially different in structure and intended operation than the nozzle assembly of the present invention.

SUMMARY OF THE INVENTION

The liquid distribution assembly of the present invention broadly comprises a unique combination for first creating a diverging, generally frusto-conical curtain of a liquid such as hot water which is comprised of a plurality of liquid particles each travelling along substantially rectilinear paths, and embodying structure for then dispersing the curtain of liquid over a relatively wide planar area to thereby facilitate cooling of the water.

In practice, the curtain-creating means preferably is in the form of a known type of hollowcone, swirl-type nozzle which comprises a hollow, liquid-receiving body presenting an apertured, depending, frustoconical liquid-delivery section, with a tubular liquid entryway disposed tangentially relative to the larger diameter end of the frustoconical section. The water-dispersing structure on the other hand preferably includes a plurality of generally circular liquid-dispersing buttons or members each presenting a liquid contacting surface, with means mounting the members in spaced relationship to one another and in a disposition for being contacted by the descending water particles making up the curtain. Each liquid-contacting surface of the respective buttons is configured such that the paths of travel of the water particles contacting the surface is disposed angularly thereto.

In more preferred forms, each of the buttons or members include an arcuate upper surface portion adjacent the nozzle, and the buttons are arranged in a circular pattern and are circumferentially spaced from one another in order to allow adequate water flow past the buttons.

The water delivery aperture of the nozzle, and the circular area defined by the water-dispersing member, are sufficient to safely clear the cleaning balls conventionally used with water cooling systems, so that nozzle jam ups are prevented.

DESCRIPTION OF THE PREFERRED EMBODIMENT

Figure 1:
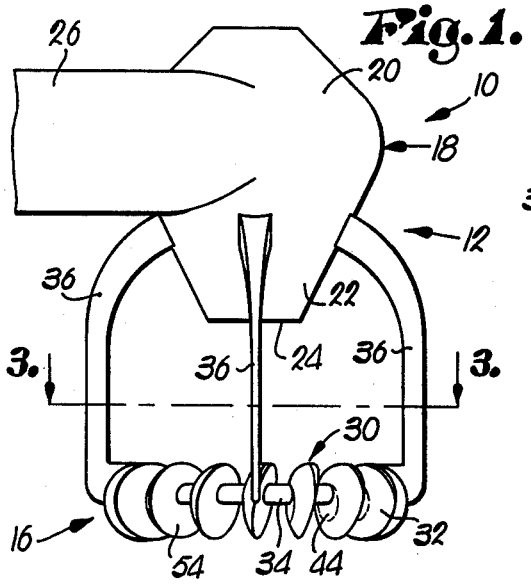
FIG. 1 is a side elevational view of a liquid distribution assembly in accordance with the invention.

Turning now to the drawing, a liquid distribution assembly 10 in accordance with the invention is illustrated in FIG. 1 and comprises means referred to by the numeral 12 for creating a diverging, downwardly directed, generally frustoconical hollow curtain 14 (see FIG. 4) of liquid (e.g., water) along with structure 16 for dispersing the curtain 14 to enhance cooling thereof.

Figure 4:
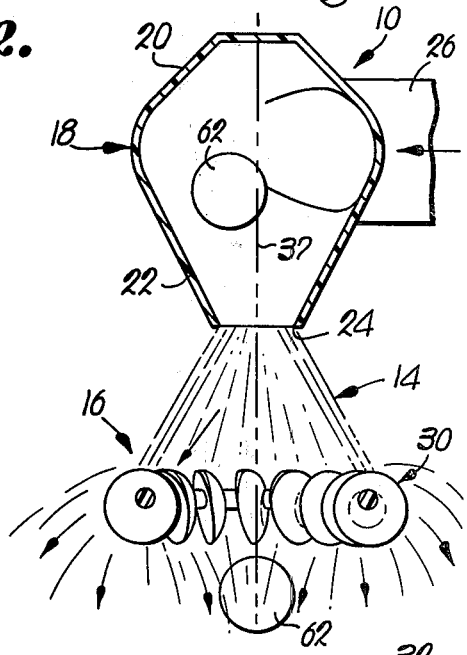
FIG. 4 is a vertical sectional view of the assembly illustrated in FIG. 1, with certain parts being omitted for clarity and with water system clean-out balls shown passing through the distribution assembly.

In more detail, curtain creating means 12 is preferably in the form of a hollow-cone, swirl-type nozzle 18 having a hollow, liquid-receiving body 20 and a hollow, depending, frustoconical liquid-delivery section 22. The section 22 terminates in a central circular delivery aperture 24 for delivery of hot water out of the nozzle. A tubular water entryway 26 is also provided, and as best seen in FIGS. 1 and 4, is disposed essentially tangentially relative to the larger diameter end of frustoconical section 22.

Figure 5:
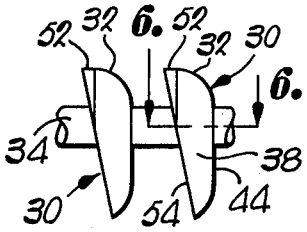
FIG. 5 is an enlarged fragmentary view illustrating a pair of adjacent water-dispersing buttons forming a part of the invention.

Liquid-dispersing means 16 include a plurality of respective liquid-dispersing buttons or members 30 each presenting a liquid contacting surface 32 (see FIG. 5). The members 30 are arranged in a substantially circular pattern and are in circumferentially spaced relationship to one another. To this end, a circular mounting ring 34 is provided, and the respective buttons 30 are equidistantly spaced around and supported by the ring 34.

In preferred forms, the ring 34 and buttons 30 are molded as an integral unit, and this unit also includes two or more (shown as four for illustration purposes) upwardly extending, L-shaped mounting legs 36 which are spaced about ring 34. The uppermost ends of the legs 36 are secured (either removably or permanently) to the body 20 of nozzle 18 as indicated in FIG. 1, in order to properly orient the ring 34 and members 30 centrally below nozzle 18. In this orientation, the longitudinal axis 37 (see FIG. 4) of frustoconical section 22 is coincident with the axis of ring 34; moreover, the innermost edges of the members 30 lie in an imaginary circle which has a diameter greater than that of the aperture 24.

Figure 6:
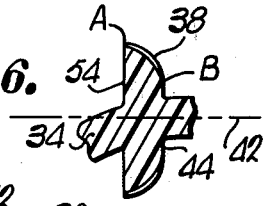
FIG. 6 is a sectional view taken along line 6—6 of FIG. 5.

It will be seen that the surface 32 of each member 30 is configured to present an arcuate, annular, shoulder-like surface portion 38 which extends around the member. The surface portion 38 is generated and defined by an arc (i.e., the arc extending between points "A" and "B" in FIG. 6) which lies in a first vertical plane (represented by dashed line 40 of FIG. 3) and which has been rotated about an axis 42 (see FIG. 6) which lies in plane 40 and is spaced from arc 38. Plane 40 is also parallel to axis 37.

The surface 32 of each member 30 is also provided with a circular planar front wall 44 which is contiguous with the outermost periphery of the surface 38. Again referring to FIG. 3, it will be seen that the front wall 44 (and thereby the outermost periphery of the surface 38) lies in a second vertical plane, represented by dotted line 46. Plane 46 is at an angle with respect to a third plane, represented by dotted line 48, which is radially oriented relative to the ring 34 and intersects both axis 37 and the line of intersection between the planes 40, 46. The angle 50 between the planes 46, 48 can be up to about 45°, depending upon the spacing of buttons 30, waterloading thereon, and the button configuration; in the most preferred form as shown however, this angle is about 12°.

Each member 30 is further defined by a cylindrical surface portion 52 which is in effect a frustum of a cylinder extending between the margin of surface 38 remote from face 44 towards the obliquely oriented back wall 54 of the member 30.

Such a button member of preferred configuration may be generated by taking a one inch rod and forming a $\frac{1}{4}$ inch radius at one end around the circumference. Then, by slicing such rod at an angle of about 12° with respect to its axis and located such that the slice plane is about 0.21 inches from the end of the rod at the center line. This configuration is best depicted in FIG. 5.

Figure 7:
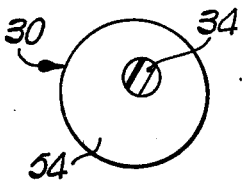
FIG. 7 is a rear view of one of the water-dispersing buttons.
Figure 8:
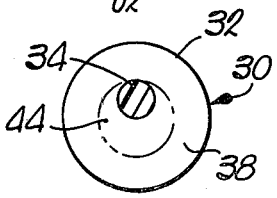
FIG. 8 is a front view of the button illustrated in FIG. 7.

With reference to FIGS. 7 and 8, it will be seen that wall 54 is of arcuate configuration and has a greater area than the corresponding front wall 44. In addition, it will be seen that the buttons 30 are mounted on the ring 34 such that each front wall 44 is perpendicular in a vertical plane relative to the ring 34; and that the described planes 40 and 46 are perpendicular to one another.

Figure 3:
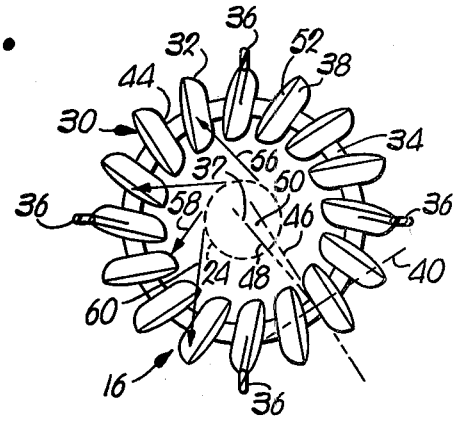
FIG. 3 is a sectional view taken along line 3—3 of FIG. 1, with the outline of the water delivery aperture of the nozzle being illustrated in phantom, and certain geometrical relationships of the assembly being depicted by broken lines.
Figure 2:
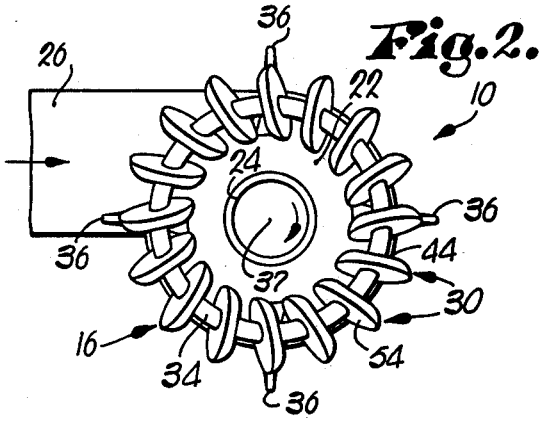
FIG. 2 is a bottom plan view of the assembly illustrated in FIG. 1.

In the use of assembly 10, volumes of initially hot water to be cooled are conveyed through entryway 26 tangentially into the body 20. This produces a swirling action within the hollow body and section 22, until the water reaches delivery aperture 24. At this point the water is delivered from the section 22 in the form of the downwardly directed, diverging, generally frustoconical hollow curtain 14. In practice, this "hollow cone" delivery produces a curtain containing the bulk of the water within a thickness normally ranging from about $\frac{1}{8}$ to $\frac{1}{4}$ inch. Furthermore, the curtain is comprised of a plurality of individual liquid particles each of which travel along a substantially rectilinear path. Referring specifically to FIG. 3, one such path is illustrated by vector line 56. As can be seen, the path extends rectilinearly from aperture 24 to one of the buttons 30, such that the corresponding water particle will strike the associated button 30 at the upper area thereof above ring 34. It will also be noted that the paths of travel of all water droplets leaving aperture 24 are rectilinear, and that, because of the construction and orientation of the members 30, the paths of travel of essentially all of the particles are disposed at an angle relative to the members they impinge against. The result of this arrangement is that the initially hollow-cone delivery of water from the nozzle 18 is converted into an essentially full-cone water pattern below the structure 16; and this in turn greatly facilitates adequate cooling of the water.

The primary purpose of the arcuate face 32 of each button member is to present incremental impact surfaces at varying angles to the water within the curtain so as to get the desired water dispersion at any given pressure. For example, the paths of the innermost individual water particles within the curtain 14 may impinge the corresponding members adjacent the innermost margins thereof as illustrated by vector line 58. On the other hand, the paths of the outer water particles of curtain 14 will impinge against the outer margins of the buttons, and this situation is illustrated by vector line 60.

It is believed that the upper portions of the buttons 30 (i.e., at a level with or above the ring 34) are most important in achieving the results of the invention, and that the lower portions of the buttons may be omitted in certain configurations. Moreover, while the specific configuration of the members 30 is preferred, it is believed that other surface configurations could be successfully employed.

The distribution assembly 10 has been found to be efficiently operable at very low head requirements while still retaining its foreign object clearing characteristics. For example, tests have shown that it operates satisfactorily at heads of the order of four feet and this is an especially important fact in that utilities now evaluate pump head costs on the basis of at least about $200,000 per foot (cost of fuel over 30–40 year period and costs of pumps for that duty) for a water circulating rate of 500,000 gallons per minute.

As noted above, it is a common practice to employ foamed plastic or cellular synthetic resin rubber-like balls in water cooling system for the purpose of clean-out of heat exchanger tubes. As illustrated in FIG. 4 assembly 10 of the present invention can safely and easily handle such balls, referred to by the numeral 62. Such balls as indicated are normally from ½ to 1½ inches in diameter, and the assembly 10 is preferably sized to easily accommodate the balls. Additionally, the large circle defined by the inner edges of members 30 relative to aperture 24, allows the balls to pass from the aperture 24 and centrally out of the entire assembly without jam ups. The same is true as to other foreign materials or objects.

Furthermore, the use of a swirl-type, hollow cone nozzle allows use of a water distributor having a larger water orifice for foreign object clearing than would otherwise be the case with a straight discharge nozzle because of the fact that much less water is discharged from the hollow cone nozzle notwithstanding its large orifice size than a conventional nozzle.

Having thus described the invention, what is claimed as new and desired to be secured by Letters Patent is:

1. A liquid distribution assembly for use in counter-flow liquid cooling towers and comprising:

a hollow-cone swirl-type nozzle including a liquid inlet and a liquid outlet for creating a hollow, generally frusto-conical curtain of liquid which diverges outwardly from said outlet, said curtain being comprised of liquid particles each traveling along substantially rectilinear paths, with the hollow region defined by said curtain immediately below said outlet being unobstructed for free passage of foreign objects therethrough and relatively free of liquid flow therethrough; and structure for dispersing said curtain of liquid, including:

a plurality of stationary liquid-dispersing members each presenting a liquid-contacting surface; and means mounting said members below said outlet, in horizontally spaced relationship to one another presenting an annular ring and in disposition such that a substantial number of said liquid particles contact said liquid-contacting surfaces, there being an open, unobstructed region below said nozzle outlet and cooperatively circumscribed by said members which has an area greater than the area of said nozzle outlet, both of said areas being measured transversely of the longitudinal axis of said frustoconical curtain, the hollow region defined by said curtain being in communication with said member-defined region for allowing unobstructed passage of said foreign objects from said nozzle outlet, through said communicated regions, and away from said assembly without substantial interference with the latter, each of said liquid-contacting surfaces being configured such that the paths of travel of the liquid particles contacting a respective surface are disposed angularly relative thereto.

2. The assembly as set forth in claim 1 wherein each of said liquid-contacting surfaces includes an arcuate surface portion.

3. The assembly as set forth in claim 2 wherein the longitudinal axis of said liquid curtain is substantially vertical, and each of said liquid-contacting surfaces is configured to present an arcuate surface portion generated and defined by an arc lying in a first plane parallel to said longitudinal axis which has been rotated about an axis lying in said first plane and spaced from said arc.

4. The assembly as set forth in claim 3 wherein the outermost periphery of said arcuate surface portion lies in a second plane, said second plane being at an angle relative to a third plane which intersects both said longitudinal axis and the line of intersection of said first and second planes.

5. The assembly as set forth in claim 4 wherein said angle is up to about 45 degrees.

6. The assembly as set forth in claim 5 wherein said angle is about 12 degrees.

7. The assembly as set forth in claim 2 wherein said arcuate surface portion is of annular configuration.

8. The assembly as set forth in claim 2 wherein each of said liquid-contacting surfaces is configured to present a circular front wall, a back wall, and an annular, arcuate shoulder extending from said front wall towards said back wall.

9. The assembly as set forth in claim 8 including a cylindrical surface portion which defines a frustum of cylinder extending between the margin of said shoulder remote from said front wall towards said back wall, said cylindrical surface portion extending around the portion of said member adjacent said curtain-creating means.

10. The assembly as set forth in claim 8 wherein said back wall has a greater area than said front wall, and is obliquely oriented relative to the front wall.

11. The assembly as set forth in claim 2 wherein each of said liquid-contacting surfaces also includes a cylindrical surface portion.

12. The assembly as set forth in claim 1 wherein said mounting means comprises:

a generally circular ring for supporting said members; and means for mounting said ring in spaced relationship to said curtain-creating means.

13. The assembly as set forth in claim 1 wherein said members are circularly arranged below said outlet and are equidistantly spaced laterally from the latter, the diameter of the circle defined by the inner edges of said members being larger than the diameter of said outlet.

* * * * *